US012501925B2

(12) United States Patent
Hideshima

(10) Patent No.: US 12,501,925 B2
(45) Date of Patent: Dec. 23, 2025

(54) AEROSOL GENERATING ARTICLE WITH A TIPPING WRAPPER

(71) Applicant: JT International S.A., Geneva (CH)

(72) Inventor: Taku Hideshima, Luxembourg (LU)

(73) Assignee: JT International SA (CH)

( * ) Notice: Subject to any disclaimer, the term of this patent is extended or adjusted under 35 U.S.C. 154(b) by 876 days.

(21) Appl. No.: 17/611,753

(22) PCT Filed: Jul. 6, 2020

(86) PCT No.: PCT/EP2020/068958
§ 371 (c)(1),
(2) Date: Nov. 16, 2021

(87) PCT Pub. No.: WO2021/008916
PCT Pub. Date: Jan. 21, 2021

(65) Prior Publication Data

US 2022/0232883 A1 Jul. 28, 2022

(30) Foreign Application Priority Data

Jul. 12, 2019 (EP) ..... 19185929

(51) Int. Cl.
*A24D 1/02* (2006.01)

(52) U.S. Cl.
CPC ..... *A24D 1/02* (2013.01)

(58) Field of Classification Search
CPC ..... A24D 1/02
See application file for complete search history.

(56) References Cited

U.S. PATENT DOCUMENTS

| | | | | |
|---|---|---|---|---|
| 2,307,239 | A * | 1/1943 | Rowland | D21H 19/40 501/129 |
| 5,830,318 | A * | 11/1998 | Snow | A24C 5/56 131/365 |
| 6,405,734 | B1 * | 6/2002 | Hanada | A24D 1/02 131/365 |
| 2002/0157678 | A1 * | 10/2002 | Hampl, Jr. | A24D 1/02 131/365 |
| 2005/0087203 | A1 * | 4/2005 | Takeda | A24D 1/02 131/365 |
| 2011/0180088 | A1 * | 7/2011 | Hooper | A24D 1/02 131/365 |
| 2013/0104915 | A1 | 5/2013 | Eitzinger | |
| 2015/0114414 | A1 | 4/2015 | Fritzsching et al. | |
| 2016/0208440 | A1 | 7/2016 | Byrd, Jr. et al. | |
| 2017/0238603 | A1 * | 8/2017 | Papakyrillou | A24D 1/045 |
| 2017/0280766 | A1 * | 10/2017 | Besso | A24D 1/02 |
| 2018/0092397 | A1 | 4/2018 | Pesendorfer et al. | |
| 2020/0323258 | A1 | 10/2020 | Sakurai et al. | |
| 2021/0161201 | A1 * | 6/2021 | Aoun | A24D 1/20 |

FOREIGN PATENT DOCUMENTS

| | | | | |
|---|---|---|---|---|
| JP | H08246396 | A | 9/1996 | |
| JP | 2012507287 | A | 3/2012 | |
| JP | 2013524026 | A | 6/2013 | |
| JP | 2015091232 | A | 5/2015 | |
| KR | 20140013307 | A | 2/2014 | |
| KR | 101811074 | B1 | 12/2017 | |
| WO | 2010051076 | A1 | 5/2010 | |
| WO | 2015108078 | A1 | 7/2015 | |
| WO | 2019130446 | A1 | 7/2019 | |
| WO | WO-2020025735 | A1 * | 2/2020 | A24C 5/01 |

OTHER PUBLICATIONS

International Search Report for Application No. PCT/EP2020/068958 mailed Sep. 29, 2020, pp. 1-3.

* cited by examiner

*Primary Examiner* — Michael H. Wilson
*Assistant Examiner* — Adam Z Baratz
(74) *Attorney, Agent, or Firm* — Lerner David LLP

(57) ABSTRACT

A cigarette has a tipping wrapper connecting a mouthpiece rod and a tobacco rod, wherein the mouthpiece rod and the tobacco rod each have a cylindrical shape with a respective longitudinal axis arranged as a surface normal of the base area of the respective cylindrical shape, wherein the tipping wrapper is circumferentially wrapped around the mouthpiece rod and the tobacco rod at least in part along their consecutively arranged longitudinal axes, has an inner surface directed towards the mouthpiece rod and tobacco rod and an oppositely arranged outer surface and includes at least wood pulp. The tipping wrapper further includes at least 20% of clay and/or $Al(OH)_3$, has a porosity equal to or less than 5.0 C.U. and a surface smoothness of more than 100 sec (Bekk) on the outer surface.

15 Claims, 3 Drawing Sheets

AEROSOL GENERATING ARTICLE WITH A TIPPING WRAPPER

CROSS-REFERENCE TO RELATED APPLICATIONS

The present application is a national phase entry under 35 U.S.C. § 371 of International Application No. PCT/EP2020/068958, filed Jul. 6, 2020, published in English, which claims priority to European Application No. 19185929.7 filed Jul. 12, 2019, the disclosures of which are incorporated herein by reference.

BACKGROUND OF THE INVENTION

The present invention relates to an aerosol generating article with a tipping wrapper connecting a mouthpiece rod and a tobacco rod, wherein the mouthpiece rod and the tobacco rod each have a cylindrical shape with a respective longitudinal axis arranged as a surface normal of the base area of the respective cylindrical shape, wherein the tipping wrapper is circumferentially wrapped around the mouthpiece rod and the tobacco rod at least in part along their consecutively arranged longitudinal axes, has an inner surface directed towards the mouthpiece rod and tobacco rod and an oppositely arranged outer surface and consists at least of wood pulp.

The main objective of the tipping wrapper, also often referred to as "tipping paper" in the art, is to connect the mouthpiece rod and the tobacco rod of an aerosol generating article. The tipping paper circumferentially covers the mouthpiece rod at least in part along its longitudinal axis, a smoldering resistance or non-combustibility of the tipping paper is desired, so the consumer is shielded from the burning aerosol generating article. This smoldering resistance or non-combustibility is achieved by addition of non-combustible fillers to the tipping paper, such as titanium dioxide ($TiO_2$), kaolin and aluminum hydroxide ($Al(OH)_3$).

Due to recent health concerns regarding $TiO_2$ as a filler for tipping papers, it is desirable to develop a tipping paper without any $TiO_2$. Such a $TiO_2$-free tipping paper should of course then comprise at least the same grade of smoldering resistance/non-combustibility as $TiO_2$-containing tipping papers. Furthermore, the $TiO_2$-free tipping paper should fulfill the same qualities as a $TiO_2$-containing tipping paper regarding production, cost and wastage during aerosol generating article production.

BRIEF SUMMARY OF THE INVENTION

The afore mentioned objective is reached by an aerosol generating article with a tipping wrapper connecting a mouthpiece rod and an aerosol generating material rod, wherein the mouthpiece rod and the tobacco rod each have a cylindrical shape with a respective longitudinal axis arranged as a surface normal of the base area of the respective cylindrical shape, wherein the tipping wrapper is circumferentially wrapped around the mouthpiece rod and the tobacco rod at least in part along their consecutively arranged longitudinal axes, has an inner surface directed towards the mouthpiece rod and tobacco rod and an oppositely arranged outer surface and consists at least of wood pulp. The invention is characterized in that the tipping wrapper further comprises at least 20% of clay and/or $Al(OH)_3$, has a porosity equal to or less than 5.0 C.U. and a surface smoothness of more than 100 sec (Bekk) on the outer surface.

The tipping wrapper according to this invention is free of titanium dioxide. In other words, the tipping wrapper contains 0% $TiO_2$. To ensure the sufficient smoldering resistance and non-combustibility, at least 20% of clay and/or aluminum hydroxide ($Al(OH)_3$) are used as fillers in the tipping wrapper in combination with the maximum porosity of 5.0 C.U. The term filler refers to a specific filler material, which is added to the pulp slurry from which the tipping wrapper is manufactured and uniformly blended therein. All percentages given in this application are weight percentages of the weight of the dry material in proportion to the weight of the complete dry material basis of the tipping wrapper. The dry material basis of the tipping wrapper at least includes wood pulp and the respective filler materials, e.g. clay and/or $Al(OH)_3$. The dry material basis of the tipping wrapper may also include further ingredients.

The smoldering resistance and non-combustibility is achieved by the low porosity of equal or less than 5.0 C.U. in combination with at least 20% of clay and/or aluminum hydroxide ($Al(OH)_3$) as fillers. The porosity is given in Coresta Units (C.U.). 1 Coresta Unis is defined as the volumetric flow rate of air ($cm^3\ min^{-1}$) passing through a 1 $cm^2$ sample of substrate at an applied pressure difference of 1 kPa. The higher the C.U. value, the higher the porosity. With 5.0 C.U. the tipping wrapper exhibits a very reduced porosity. This reduces the surface area of the tipping wrapper. It may also reduce the oxygen transport in the tipping wrapper and therefor impedes any smoldering or combustion processes.

The surface smoothness of more than 100 sec (Bekk) ensures sufficient machine run ability. Also, it ensures the fixability of any ink printing that may be arranged at least on a part of the outer surface of the tipping wrapper. The ink fixability is a very important parameter in the aerosol generating article production, as a tipping wrapper without sufficient ink fixability shows ink abrasion on aerosol generating article making machine, which will collect as ink-dust at and around the rollers of the tipping wrapper feeder. This ink-dust there deteriorates the machine run ability of the tipping wrapper and therefore also deteriorates the whole production quality.

The smoothness of the surface of a sheet material can be quantified by measuring the Bekk smoothness of the surface using a Bekk smoothness tester in accordance with ISO 5627:1995. In this test, air at a specified pressure is leaked between a smooth glass surface and the sample of the sheet material, and the time (in seconds) for a fixed volume of air (10 ml) to seep between these surfaces is measured. This time corresponds to the Bekk smoothness, which is therefore also expressed in units of seconds. The higher the Bekk smoothness value, the smoother the surface of the sheet material.

The porosity and surface smoothness of the tipping wrapper are affected by the tipping wrapper composition. In the tipping wrapper composition, the filler combination and amount plays a major role. Therefore, the filler types, their respective amount and/or the filler-to-pulp ratio can be used to adjust the porosity and the surface smoothness of the tipping wrapper. In other words, the achieved porosity and/or surface smoothness is a result of the specific fillers and their respective amounts.

Further, it is possible to optimize the porosity and/or surface smoothness of the tipping wrapper by changes in the pulp treatment process. For example, the pulp type or the pulp refining process can be changed but it may also be possible to use other manufacturing parameters during the manufacturing of the tipping wrapper to optimize the porosity and/or surface smoothness.

The tipping wrapper may further comprise 1-3% talc. Talc is a well-known additive and improves the wrapper uniformity. This is advantageous in terms of wastage and machine run quality.

According to another embodiment, the tipping wrapper comprises a printing on at least a part of the outer surface. With a printing on the outer surface, the ink-fixability of the tipping wrapper is of high importance. Preferably, the printing covers the whole outer surface of the tipping wrapper. Preferably, the ink, with which the printing is printed, comprises a lip-release agent and/or a pigment. With the lip-release agent, a sticking of the consumers lips to the tipping wrapper is prohibited or at least significantly reduced. With the pigment decoration can be added to the outer surface of the tipping wrapper. The printing may also comprise different colors. The different colors are preferably realized by using different inks with different pigments. A preferred printing is the so called "cork on white", which denotes a widely known tipping wrapper printing resembling a cork material.

According to another embodiment, the tipping wrapper further comprises at least 4% $CaCO_3$. The addition of calcium carbonate ($CaCO_3$) improves the ink-fixability of the tipping wrapper to ensure even better machine run ability. The addition of $CaCO_3$ can negatively affect the smoldering resistance or non-combustibility of the tipping wrapper. But with the superior smoldering resistance/non-combustibility of the invention a combination with at least 4% $CaCO_3$ is possible.

According to another embodiment the tipping wrapper has a porosity of equal or less than 3.0 C.U. With the further reduced porosity values the smoldering resistance/non-combustibility of the tipping wrapper is further improved. Preferably, the porosity is between 1.0-3.0 C.U., particularly preferred between 1.5-3.0 C.U. By further optimizing the porosity value, a higher calcium carbonate content can be compensated. Therefore, this embodiment can be advantageously combined with the preceding embodiment of a $CaCO_3$ content of at least 4%.

According to another embodiment, the tipping wrapper has an opacity of more than 78%. Preferably, the tipping wrapper has an opacity of more than 80%. These opacity values ensures an adequate appearance of the tipping wrapper. In particular, the underlying materials can be seen through the tipping wrapper less, which improves the visual appearance of the resulting aerosol generating article. Also, any printings on the outer surface of the tipping wrapper appear more clearly and with higher color quality.

According to another embodiment, the tipping wrapper has a brightness of more than 80%. Preferably, the tipping wrapper has a brightness of more than 83%. These brightness values ensures an adequate appearance of the tipping wrapper and the aerosol generating article, similar to the opacity. Also, any printings on the outer surface of the tipping wrapper appear more clearly and with higher color quality.

$TiO_2$ is a very strong white pigment. This means that even with relatively small amounts of $TiO_2$ as a filler in tipping wrappers can be achieved sufficient brightness and opacity. In this invention, $TiO_2$ is omitted due to health concerns. Instead of $TiO_2$, clay, preferably kaolin, and/or $Al(OH)_3$ are used as fillers. However, these alternative fillers do not feature the same pigment strength than $TiO_2$. It is therefore necessary to define the previously given lower threshold values for opacity and brightness. If the desired $TiO_2$-free filler combination and amount does not yield sufficient opacity and/or brightness, the threshold values may still be reached by increasing the basis weight and/or the thickness of the tipping wrapper. It is, of course, also possible to increase the filler amount, but depending on cost, availability and/or process stability, it may be beneficial to keep the filler combination and adjust the brightness and/or opacity as previously described.

According to another embodiment, the tipping wrapper has a basis weight equal to or larger than 31 gsm or 36 gsm, and/or a basis weight equal to or smaller than 50 gsm or 47 gsm. Preferably, the tipping wrapper comprises a basis weight of 36-47 g/sqm. A lower threshold for the basis weight is needed to ensure sufficient appearance (in terms of opacity and brightness) and non-combustibility. Also, the basis weight must not be too low or too high to ensure a suitable machine run ability of the tipping wrapper. This is of high importance for the production. Also, with higher basis weight values the tipping wrapper becomes brighter and opaquer as previously described. Therefore, a higher basis weight can be beneficial if a filler or filler combination with low pigment strength is used.

According to another embodiment, the tipping wrapper has a thickness equal to or larger than 30 μm or 35 μm and/or a thickness equal to or smaller than 55 μm or 50 μm. Preferably, the tipping wrapper has a thickness of 35-50 μm. The thickness is also an important parameter regarding the machine run ability of the tipping wrapper. Without the correct thickness, the tipping wrapper will exhibit poor machine run ability which will impede the correct functioning of the production machinery. Also, with a higher thickness the tipping wrapper becomes brighter and opaquer as previously described. Therefore, a higher thickness can be beneficial if a filler or filler combination with low pigment strength is used. However, the tipping wrapper should preferably not exceed a thickness of 55 μm to still guarantee the needed machine run ability.

According to another embodiment, the tipping wrapper comprises perforations, especially laser perforations. Preferably, such perforations are manufactured with a laser perforation process on aerosol generating article making machine (OLL). The perforations improve the ventilation properties of the aerosol generating article to which the tipping wrapper is affixed. During the laser perforation process, the tipping wrapper may generate ash dust, which is undesirable. With the specific filler combination of this invention ash dust generation is significantly reduced.

The afore mentioned objective is also reached by a tipping wrapper connecting a mouthpiece rod and a tobacco rod, wherein the mouthpiece rod and the tobacco rod each have a cylindrical shape with a respective longitudinal axis arranged as a surface normal of the base area of the respective cylindrical shape, wherein the tipping wrapper is circumferentially wrapped around the mouthpiece rod and the tobacco rod at least in part along their consecutively arranged longitudinal axes, has an inner surface directed towards the mouthpiece rod and tobacco rod with which it is fixed at the mouthpiece rod and the tobacco rod and an oppositely arranged outer surface and consists at least of wood pulp. The invention is characterized in that the tipping wrapper further comprises at least 20% of clay and/or $Al(OH)_3$, has a porosity equal to or less than 5.0 C.U. and a surface smoothness of more or equal than 100 sec (Bekk) on the outer surface.

According to another embodiment, the smoothness of the outer surface is 100-250 sec (Bekk). Preferably, the smoothness of the outer surface is equal to or larger than 100 sec (Bekk), 110 sec (Bekk) or 130 sec (Bekk) and/or a smoothness of the outer surface equal to or smaller than 250 sec (Bekk), 200 sec (Bekk) or 170 sec (Bekk). With the correct smoothness of the outer surface, sufficient machine run ability is ensured. Also, an improved ink fixability is provided. With the lower and upper threshold of the smoothness values sufficient ink fixability can be provided, preferably along with superior appearance and haptic properties of the tipping wrapper.

According to another embodiment, the tipping wrapper contains 4-20% $CaCO_3$. Preferably, the tipping wrapper contains 4-15% $CaCO_3$ or even more preferably 4-13.5% $CaCO_3$. With the calcium carbonate ($CaCO_3$), the tipping wrapper features improved ink-fixability. As the addition of $CaCO_3$ can negatively affect the smoldering resistance/the non-combustibility of the tipping wrapper, an upper threshold of the calcium carbonate content is preferred. Preferably, the porosity is reduced and/or other filler amounts are increased, if higher $CaCO_3$ contents are used. Preferably a porosity of equal or less than 3.0 C.U. is combined with a clay and/or $Al(OH)_3$ content of at least 23%, if a $CaCO_3$ content of 13% or more is used.

According to another embodiment, the tipping wrapper contains 10-30% clay. Preferably, the tipping wrapper contains 12-25% clay, even more preferably 13.5-24% clay. Preferably, kaolin is used as clay. Nevertheless, it may also be conceivable to use other types of clay instead. The amount of clay, preferably kaolin, provides sufficient smoldering resistance/non-combustibility for the tipping wrapper. As kaolin is a white pigment, kaolin also supports the brightness and opacity of the tipping wrapper.

According to another embodiment, the tipping wrapper contains 0-15% $Al(OH)_3$. Preferably, the tipping wrapper contains 0-13% $Al(OH)_3$, even more preferably 0-11% $Al(OH)_3$. Aluminum hydroxide provides strong flame-retardant properties. $Al(OH)_3$ is therefore used to provide sufficient smoldering resistance/non-combustibility to the tipping wrapper. However, $Al(OH)_3$ is also high in cost and has a poor procurement stability and varying process capability. Therefore, it is also conceivable to omit $Al(OH)_3$ completely.

According to another embodiment, the tipping wrapper comprises 0% $Al(OH)_3$, has a porosity of less than 2 C.U., a $CaCO_3$ content of less than 5% and a clay content of at least 20%. The given parameter ranges are preferred to provide sufficient smoldering resistance/non combustibility without the strong flame-retardant properties of the $Al(OH)_3$. This is advantageous, as $Al(OH)_3$ exhibits difficulties in term of high cost, poor procurement stability and varying process capability. Preferably, a $TiO_2$-free and $Al(OH)_3$-free tipping wrapper is provided, that meets the requirements in terms of smoldering resistance/non-combustibility.

BRIEF DESCRIPTION OF THE DRAWINGS

Further advantages, objectives and features of the present invention will be described, by way of example only, in the following description with reference to the appended figures. In the figures, like components in different embodiments can exhibit the same reference symbols.

The figures show.

DETAILED DESCRIPTION

Figure 1:
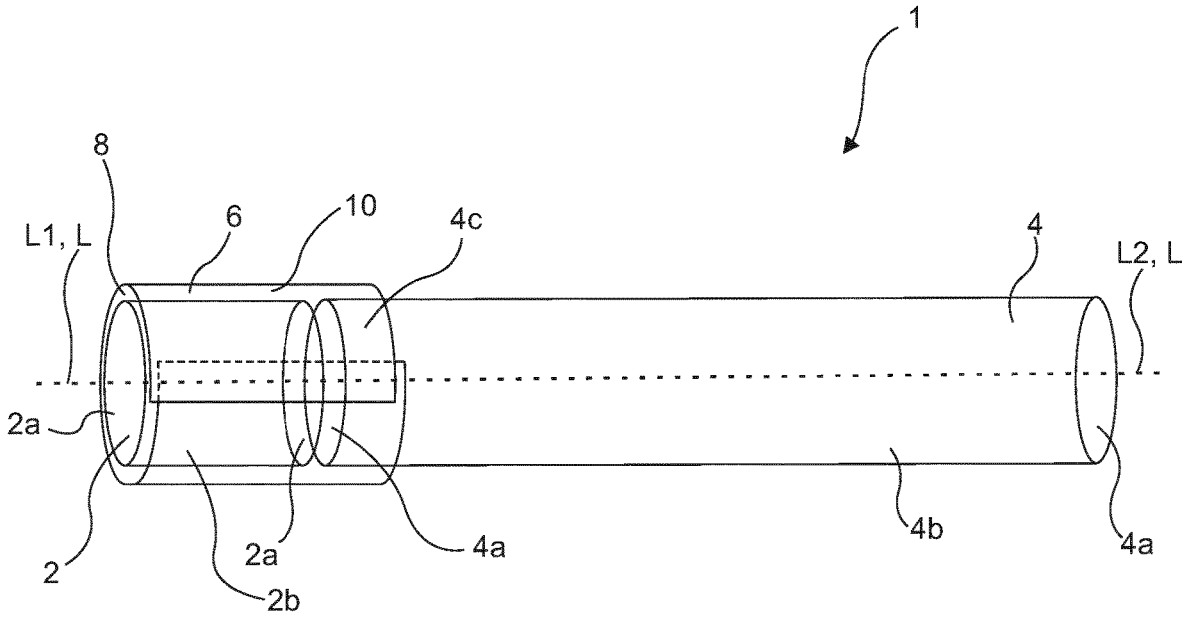
FIG. 1 a general view of an aerosol generating article 1 with a tipping wrapper 6.

FIG. 1 shows a general view of an aerosol generating article in the form of a cigarette 1 with a tipping wrapper 6, also referred to in the following as tipping paper 6. The tipping paper 6 is wrapped circumferentially around the mouthpiece rod 2 and around the tobacco rod 4. The mouthpiece rod 2 has a cylindrical shape. The cylindrical shape of the mouthpiece rod 2 comprises a longitudinal axis L1, which is arranged perpendicular to the base faces 2*a* of the cylindrical shape. Preferably, the mouthpiece rod 2 consists of a monoacetate filter. The tobacco rod 4 also has a cylindrical shape with a longitudinal axis L2. This longitudinal axis L2 is arranged perpendicular to the base faces 4*a* of the cylindrical shape of the tobacco rod 4. Preferably, the cylindrical shape of the tobacco rod 4 is longer with respect to the longitudinal axes L1, L2 compared to the cylindrical shape of the mouthpiece rod 2. Preferably, the mouthpiece rod 2 and the tobacco rod 4 have the same diameter. Preferably, the tobacco rod 4 comprises a cut tobacco material and a cigarette paper, which encloses the tobacco material at least in the circumferential direction of the cylindrical shape.

The longitudinal axes L1, L2 coincide, forming a joint longitudinal axis L. The mouthpiece rod 2 and the tobacco rod 4 are arranged consecutively along the joint longitudinal axis L. This means that one of the base faces 2*a* of the mouthpiece rod 2 is arranged directly adjacent to one of the base faces 4*a* of the tobacco rod 4. The tipping paper 6 is wrapped circumferentially around the mouthpiece rod 2 and the tobacco rod 4. Preferably, the tipping paper 6 covers the whole lateral area 2*b* of the mouthpiece rod 2. Preferably, the tipping paper 6 covers only a circular segment 4*c* of the lateral area 4*b* of the tobacco rod 4. The circular segment 4*c* is preferably arranged directly at the base area 4*a* directly at the mouthpiece rod 2. In this way, the tipping paper 6 is affixed to both mouthpiece rod 2 and tobacco rod 4 and therefore connects the two. With its inner surface 8 the tipping paper 6 is arranged in direct contact with the mouthpiece rod 2 and the tobacco rod 4. For better visibility, the tipping paper 6 is depicted slightly distanced to the mouthpiece and tobacco rod 2, 4.

Figure 2:
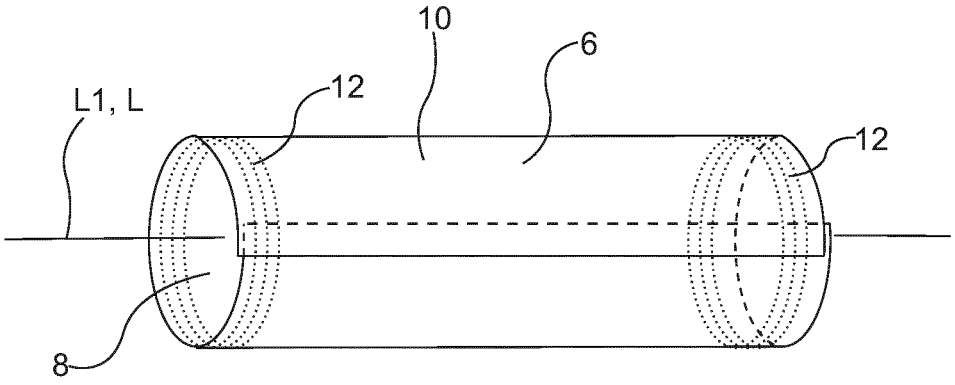
FIG. 2 a detailed view of the tipping wrapper 6 comprising perforations 12.

FIG. 2 shows a detailed view of the tipping paper 6. The tipping paper 6 comprises perforations 12. The perforations 12 denote holes in the tipping paper 6. In other words, the perforations 12 connect the outer surface 10 of the tipping paper 6 with the inner surface 8 of the tipping paper 6. The perforations 12 improve the ventilation properties of the cigarette 1 to which the tipping paper 6 is affixed. The perforations 12 may be arranged on the tipping paper in a specific pattern at specific areas of the tipping paper 6 but the perforations 12 may also be distributed uniformly over the outer surface area 10 of the tipping paper 6.

Figure 3:
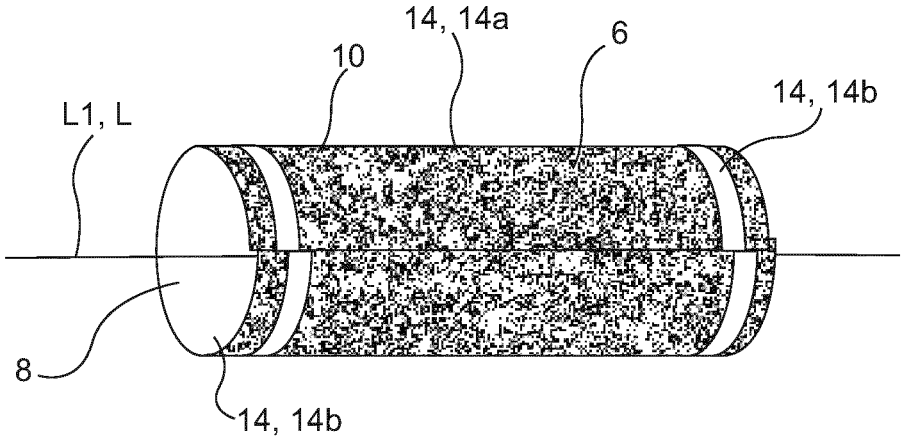
FIG. 3 a detailed view of the tipping wrapper 6 comprising a printing 14.

FIG. 3 depicts a tipping paper 6 with a printing 14. The printing 14 is arranged on the outer surface 10 of the tipping paper 6. The printing 14 may cover the outer surface 10 only in part or completely. It is also conceivable to combine several printings 14 on the outer surface 10. For example, the tipping paper 6 may comprise a first printing 14*a*, which covers the whole outer surface 10, and a second printing 14*b*, which is arranged on top of the first printing 14*a* and covers the outer surface 10 only in part. In this example, the two printings 14*a*, 14*b* may differ in color. The printing 14 may also be carried out as a hot foil stamping and/or an embossment with or without additional printing ink.

The applicant reserves his right to claim all features disclosed in the application document as being an essential feature of the invention, as long as they are new, individually or in combination, in view of the prior art. Furthermore, while the above presented preferred embodiments have been made in reference to a cigarette, the invention is not limited to such specific aerosol generating article but applies likewise to any other existing smoking articles comprising a filter and a rod of aerosol generating material comprising tobacco, in particular heat-not-burn articles. It is further noted that in the figures features are described, which can be advantageous individually. Someone skilled in the art will directly recognize that a specific feature being disclosed in a figure can be advantageous also without the adoption of further features from this figure. Furthermore, someone skilled in the art will recognize that advantages can evolve from a combination of diverse features being disclosed in one or various figures.

LIST OF REFERENCE SYMBOLS

1 Cigarette
2 mouthpiece rod
2*a* base area
2*b* lateral area
4 tobacco rod
4*a* base area
4*b* lateral area
4*c* circular segment
6 tipping paper
8 inner surface
10 outer surface
12 perforation
14 printing
14*a* first printing
14*b* second printing
L1 longitudinal axis
L2 longitudinal axis
L joint longitudinal axis

The invention claimed is:

1. An aerosol generating article with a tipping wrapper connecting a mouthpiece and an aerosol generating material rod, wherein the mouthpiece and the aerosol generating material rod each have a cylindrical shape with a respective longitudinal axis arranged as a surface normal of a base area of the respective cylindrical shape, wherein the tipping wrapper is circumferentially wrapped around the mouthpiece and the aerosol generating material rod at least in part along their consecutively arranged longitudinal axes, has an inner surface directed towards the mouthpiece and the aerosol generating material rod and an oppositely arranged outer surface and comprises at least wood pulp, wherein the tipping wrapper further comprises at least 20% of clay and/or $Al(OH)_3$, has a porosity equal to or less than 5.0 C.U. and a surface smoothness of more than 100 sec (Bekk) on the outer surface, and wherein the tipping wrapper comprises a $CaCO_3$ content of less than 5%.

2. The aerosol generating article according to claim 1, wherein:

the $CaCO_3$ content of the tipping wrapper is at least 4% and less than 5%.

3. The aerosol generating article according to claim 1, wherein:

the porosity of the tipping wrapper is equal to or less than 3.0 C.U.

4. The aerosol generating article according to claim 1, wherein:

the tipping wrapper has an opacity of more than 78%.

5. The aerosol generating article according to claim 1, wherein:

the tipping wrapper has a brightness of more than 80%.

6. The aerosol generating article according to claim 1, wherein:

the tipping wrapper has a basis weight equal to or larger than 36 gsm and equal to or smaller than 47 gsm.

7. The aerosol generating article according to claim 1, wherein:

the tipping wrapper has a thickness equal to or larger than 35 μm and equal to or smaller than 50 μm.

8. The aerosol generating article according to claim 1, wherein:

the tipping wrapper comprises perforations.

9. The aerosol generating article according to claim 1, wherein:

the tipping wrapper comprises a printing on at least a part of the outer surface.

10. A tipping wrapper for connecting a mouthpiece and an aerosol generating material rod of an aerosol generating article, wherein the tipping wrapper has an inner surface applicable in use towards the mouthpiece and the aerosol generating material rod and an oppositely arranged outer surface and comprises at least wood pulp and a calcined clay filler, wherein the tipping wrapper further comprises at least 20% of clay and/or $Al(OH)_3$, has a porosity equal to or less than 5.0 C.U. and a surface smoothness of greater than or equal to 100 sec (Bekk) on the outer surface, and wherein the tipping wrapper comprises a $CaCO_3$ content of less than 5%.

11. The tipping wrapper according to claim 10, wherein:

the smoothness of the outer surface is 100-250 sec (Bekk).

12. The tipping wrapper according to claim 10, wherein:

the $CaCO_3$ content of the tipping wrapper is at least 4% and less than 5%.

13. The tipping wrapper according to claim 10, wherein:

the tipping wrapper comprises 10-30% clay.

14. The tipping wrapper according to claim 10, wherein:

the tipping wrapper comprises 0-15% $Al(OH)_3$.

15. The tipping wrapper according to claim 10, wherein:

the tipping wrapper comprises 0% $Al(OH)_3$ and has a porosity of less than 2 C.U.

* * * * *